United States Patent [19]

Herrmann et al.

[11] Patent Number: 4,497,886

[45] Date of Patent: Feb. 5, 1985

[54] ELECTROPHOTOGRAPHIC LIQUID DEVELOPER FOR THE REVERSAL DEVELOPMENT OF NEGATIVELY-CHARGED IMAGES

[75] Inventors: Heinz Herrmann; Hans-Joachim Schlosser, both of Wiesbaden, Fed. Rep. of Germany

[73] Assignee: Hoechst Aktiengesellschaft, Frankfurt am Main, Fed. Rep. of Germany

[21] Appl. No.: 524,590

[22] Filed: Aug. 19, 1983

[30] Foreign Application Priority Data

Aug. 25, 1982 [DE] Fed. Rep. of Germany ..... 3231505

[51] Int. Cl.[3] ..... G03G 9/12

[52] U.S. Cl. ..... 430/115; 430/137; 430/100

[58] Field of Search ..... 430/115, 137, 112, 100

[56] References Cited

U.S. PATENT DOCUMENTS

| | | | |
|---|---|---|---|
| 3,417,054 | 12/1968 | Merijan et al. | 260/66 |
| 3,542,681 | 11/1970 | Mutaffis | 252/62.1 |
| 3,674,693 | 7/1972 | Averbach | 252/62.1 |
| 4,243,736 | 1/1981 | Herrmann | 430/115 |

*Primary Examiner*—John E. Kittle
*Assistant Examiner*—John L. Goodrow
*Attorney, Agent, or Firm*—Schwartz, Jeffery, Schwaab, Mack, Blumenthal & Koch

[57] ABSTRACT

An electrophotographic liquid developer is disclosed which is useful in the development of negatively charged charge images. The developer comprises an electrically insulating carrier liquid of high electrical resistivity and a low dielectric constant, a pigment or dye, a resinous binder, a charge controller comprising a copolymer of N-vinyl-2-pyrrolidone and a methacrylic acid ester, and a poly-N-vinyl-2-pyrrolidone which has been alkylated with an α-olefin. A process for producing the liquid developer is also disclosed.

5 Claims, No Drawings

ELECTROPHOTOGRAPHIC LIQUID DEVELOPER FOR THE REVERSAL DEVELOPMENT OF NEGATIVELY-CHARGED IMAGES

BACKGROUND OF THE INVENTION

The present invention relates to an electrophotographic liquid developer for the reversal devleopment of negatively charged charge images, comprising an insulating carrier liquid of high electrical resistivity and a low dielectric constant, in which a pigment, a resinous binder, a charge controller comprising a copolymer of N-vinyl-2-pyrrolidone and a methacrylic acid ester, and conventional additives are dispersed or dissolved, and to a process for the preparation thereof.

Published European Application No. 0,001,103 (=U.S. Pat. No. 4,243,736) discloses a liquid developer containing negatively charged toner particles for direct development, i.e., for the development of positively charged electrostatic charge images, which comprises, in an electrically insulating carrier liquid, a pigment, a resinous binder, and, as the charge controller, a copolymer of N-vinyl-2-pyrrolidone and a methacrylic acid ester, either as a dispersion or as a solution. This liquid developer is, however, not adjusted to, nor suitable for, the reversal development of negatively charged charge images, for copies prepared using this developer in general show strong scumming and result in unsatisfactory image reproductions.

U.S. Pat. No. 3,542,681 discloses a negative-working electrostatic toner composition for producing positive images and reversal images, wherein a pigment and an alkylized polymer of a heterocyclic N-vinyl monomer, such as N-vinyl-2-pyrrolidone, are dispersed in an electrically insulating carrier liquid. It has been found, however, that the quality of images produced using liquid developers of this type is not satisfactory, especially in the case of reversal development. Therefore, German Offenlegungsschrift No. 1,930,783, which is based on U.S. Pat. No. 3,542,681, proposes a liquid developer containing a controlling agent, but which is suitable for a positive-working developing process only. Comparative tests have shown that this liquid developer does not yield copies of satisfactory quality when it is used for reversal development of negatively charged charge images.

In German Auslegeschrift No. 2,125,668 (=U.S. Pat. No. 3,674,693), a liquid developer for the reversal development of negatively charged charge images is described, which developer comprises a mixture of a pigment, a polycyclopentadiene resin and a phospholipid as controller, dispersed in an aliphatic carrier liquid. However, charge control by means of, for example, lecithin, cannot always be adjusted precisely enough to ensure reproducible results.

SUMMARY OF THE INVENTION

It is, therefore, the object of the present invention to provide an electrophotographic liquid developer for the reversal development of negatively charged charge images, which developer can be produced by a simple process, has a long shelf life, and yields a good quality image.

A further object of the present invention is to provide a process for preparing such a liquid developer.

These objects are achieved according to the invention with an electrophotographic liquid developer of the type previously described and additionally containing a poly-N-vinyl-2-pyrrolidone alkylated with an α-olefin. Preferably, the liquid developer contains between 0.005 and 1.0 percent by weight of alkylated poly-N-vinyl-2-pyrrolidone. Thus, a liquid developer for reversal development is provided which is similar to a liquid developer used for developing positive charge images, but which is suitable for use as reversal developer by virtue of diluting the toner concentrate with a carrier liquid in which the poly-N-vinyl-2-pyrrolidone is dissolved.

More specifically, there has been provided, in accordance with one aspect of the present invention, an electrophotographic liquid developer for the reversal development of negatively charged charge images, comprising an electrically insulating carrier liquid of high electrical resistivity and a low dielectric constant, a pigment, a resinous binder, a charge controller comprising a copolymer of N-vinyl-2-pyrrolidione and a methacrylic acid ester, and a poly-N-vinyl-2-pyrrolidone which has been alkylated with an α-olefin.

In accordance with another aspect of the present invention, there has been provided a process for preparing an electrophotographic liquid developer for the reversal development of negatively charged charge images, comprising the steps of (a) producing a homogeneous paste comprising an electrically insulating carrier liquid of a high electrical resistivity and a low dielectric constant, a pigment or a dye, a resinous binder, and a charge controller comprising a copolymer of N-vinyl-2-pyrrolidone and methacrylic acid ester; (b) diluting the homogeneous paste using a carrier liquid optionally containing a charge controller, producing a toner concentrate; and (c) mixing said toner concentrate with a carrier liquid in which a poly-N-vinyl-2-pyrrolidone alkylated with an α-olefin is dissolved, producing an electrophotographic liquid developer that is ready for use.

It is unexpected that a liquid developer well suited for use in reversal development is obtained by adding a small amount of an alkylated poly-N-vinyl-2-pyrrolidone, a known dispersing agent for pigments, to a ready-made, negatively controlled, well-dispersed liquid developer used in copiers. At present, no explanation for this effect can be given.

Further objects, features, and advantages of the present invention will become apparent from the following detailed description of preferred embodiments, considered together with examples presented below.

DETAILED DESCRIPTION OF PREFERRED EMBODIMENTS

Poly-N-vinyl-2-pyrrolidone substituted by an α-olefin is known, as shown in U.S. Pat. No. 3,417,054. It is prepared by reacting poly-N-vinyl-2-pyrrolidone with the corresponding α-olefins in the presence of organic peroxide catalysts, the reaction being performed at an elevated temperature. Poly-N-vinyl-2-pyrrolidones which carry α-olefin substituents having 12 to 20 carbon atoms have proved to be particularly advantageous. These substituents include, for example, dodecene-1, tetradecene-1, hexadecene-1, heptadecene-1, octadecene-1, nonadecene-1, eicosene-1 or low-molecular weight polybutenes. It is also possible, however, for various olefinic substituents to be present in a mixture. Alkylated poly-N-vinyl-2-pyrrolidones of this kind, which contain about 20 percent by weight of vinyl-2-pyrrolidone, can be particularly advantageously used in accordance with this invention, because the high degree of substitution results in good solubility properties. The effective amount of the additive is limited by a decrease in contrast of the images produced by an excess amount of the additive, on the one hand, and by a decreasing efficiency of the liquid developer, on the other hand. It has proved to be adequate to add about 0.005 to 1.0 percent by weight, and preferably about 0.02 to 0.5 percent by weight, of alkylated poly-N-vinyl-2-pyrrolidone.

Suitable insulating carriers liquids are, for example, aliphatic hydrocarbons, such as n-hexane, ligroine, n-heptane, n-pentane, isodecane and isooctane, and the corresponding halogen derivatives, such as perchloroethylene, all these compounds exhibiting a high insulating capacity (resistivity in excess of $10^9$ Ω.cm) and a low dielectric constant (of less than 3). Particularly suitable are, for example, commercially available hydrocarbons, such as ®Isopar E, G, L, H or K, produced by ESSO-Chemie, Hamburg. The may be used alone or in combination.

The pigments employed are known. As a rule, carbon blacks, such as channel black, furnace black or lamp black (C.I. No. of all varieties of carbon black 77 266), are employed for the preparation of black developers. Acidic carbon blacks with a mean particle size of 20–30 nm and a surface area of 80–200 $m^2/g$ (BET) are preferred. Organic pigments, such as Phthalocyanine Blue (C.I. No. 74 160), Phthalocyanine Green (C.I. No. 74 260 or 42 040), Sky Blue (C.I. No. 42 780), Rhodamine (C.I. No. 45 170), Malachite Green (C.I. No. 42 000), Methyl Violet (C.I. No. 42 535), Peacock Blue (C.I. No. 42 090), Naphthol Green B (C.I. No. 10 020), Naphthol Green Y (C.I. No. 10 006), Naphthol Yellow S (C.I. No. 10 316), Permanent Red 4R (C.I. No. 12 370), Brilliant Fast Pink (C.I. No. 15 865 or 16 105), Hansa Yellow (C.I. No. 11 725), Benzidine Yellow (C.I. No. 21 100), Lithol Red (C.I. No. 15 630), Lake Red D (C.I. No. 15 500), Brilliant Carmine 6B (C.I. No. 15 850), Permanent Red F5R (C.I. No. 12 335) and Pigment Pink 3B (C.I. No. 16 015), a.s.o. are also suitable. Inorganic pigments, for example Berlin Blue (C.I. No. Pigment Blue 27), are also useful.

A pigment or pigment mixture is preferably used, according to this invention, in the preparation of the toner. In general, pigments have less tendency to fade than dyes. In addition, copy images of high contrast can be produced using pigments, compared to copies obtained using dye-containing toners.

Suitable resinous binders are known, and are selected from the group of natural or synthetic resins. They serve to fix the pigment particles to the charge image or, after the image transfer, to fix them to a support medium, such as paper, plastic film, or metal foil. Resins which are suitable include, for example, resins which are substantially insoluble in the aliphatic hydrocarbons used as carrier liquids, such as maleic acid resins modified with natural resins, dammar, copal, shellac, colophony, hardened colophony, ester gum, maleate resins which have been modified with glyceryl esters, copolymers of styrene and butadiene, copolymers of vinyltoluene and butadiene, and the like. Dispersions of polymers in aliphatic hydrocarbons, so-called organosols or dispersimers, are also suitable.

Conventional additives which may be used include those which influence various toner properties and are selected on a case-by-case basis. They can influence the charge level, the sedimentation characteristics, the useful life, the redispersibility of agglomerates, the transferability and the wipe-resistance of the liquid developer or of the toner particles on the copy support. Waxes, in particular polyethylene waxes, paraffin waxes and chloro-paraffin waxes are suitable additives. A wax or polyethylene with a softening point in the range from 60° to 130° C. can be used in accordance with the invention. The waxes or polyethylenes mentioned possess properties which, with respect to specific weight, are similar to those of the carrier liquid used. Polymers which are soluble in aliphatic compounds, such as polyvinyl alkyl ethers, polyisobutylene, polyvinyl stearate and polyacrylates, or polymethacrylates with a higher alcohol radical, or plasticizers, such as, for example, dialkyl phthalates, are also suitable.

The invention also relates to a process for the preparation of an electrophotographic liquid developer for the reversal development of negatively charged charge images. According to the process, a mixture comprising an electrically insulating carrier liquid of a high electrical resistivity and a low dielectric constant, a pigment, a resinous binder, a charge controller comprising a copolymer of N-vinyl-2pyrrolidone and methacrylic acid ester, and conventional additives, is worked into a homogeneous paste, diluted into a toner concentrate using carrier liquid which optionally contains a charge controller, and further mixed with carrier liquid, so that a ready-made liquid developer is obtained. The toner concentrate used in the process is mixed with a carrier liquid in which is dissolved a poly-N-vinyl-2-pyrrolidone alkylated with an α-olefin. The liquid developer produced by the process preferably contains between 0.005 and 1.0 percent by weight of alkylated poly-N-vinyl-2-pyrrolidone.

With this process it is possible to produce, in a simple manner, a liquid developer suitable for reversal development from a toner concentrate which can be employed for direct development, without the need of an additional dispersing stage or an additional process step beyond dilution of the toner concentrate.

Homogenizing the mixture to obtain a paste can be performed by means of a three-roll mill, a ball mill, a colloid mill, or, preferably, an agitator ball mill, at temperatures of from room temperature up to about the boiling range of the carrier liquid. The duration of the process depends on the milling result. After milling the particles are between about 0.05 and 10 μm in size. The toner concentrates are adjusted to a solids content of about 5 to 10 percent by weight by diluting the paste while agitating at high speed.

Further mixing with carrier liquid to give the ready-for-use liquid developer may then be performed, for example, immediately before the liquid developer is employed in the copier. In general, the concentrations after mixing vary between 0.05 and 5 percent by weight.

By way of the following examples, the invention will now be explained in greater detail.

COMPARATIVE EXAMPLE 1

60 g of carbon black (BET: 96 $m^2/g$, pH 4.5) were added to 300 g of a 10 percent by weight solution, in an aliphatic hydrocarbon (boiling range: 160°–180° C.), of an alkylated poly-N-vinyl-2-pyrrolidone having a chain length of 20 carbon atoms in the alkyl group and about 20 percent by weight of vinylpyrrolidone (Antaron V220), and mixed with 160 ml of the same hydrocarbon. This mixture was milled in an agitator ball mill for 3 hours at 80° C. and, after it was cooled, diluted to give a 5 percent by weight, carbon black-containing toner concentrate. The liquid developer was then prepared by mixing 7 ml of the toner concentrate with 1 liter of the above-mentioned aliphatic hydrocarbon. With this liquid developer, a reversal development was carried out on ZnO paper in a microfilm reenlargement apparatus. The images obtained were very scummed and inappropriate for practical purposes.

COMPARATIVE EXAMPLE 2

60 g of the carbon black described in Comparative Example 1 were added to 600 g of an aliphatic hydrocarbon (boiling range: 160°–180° C.), mixed with 160 g of a 20 percent by weight solution of a grafted terpolymer comprising 76% of dodecylmethacrylate, 20% of methylmethacrylate, and 4% of N-vinyl-2-pyrrolidone in the hydrocarbon (boiling range 160°–180° C.), 30 g of a polyethylene wax (dropping point: 103°–107° C.), and 16 g of a chlorinated paraffin wax (softening point: 105° C.), and milled in an agitator ball mill under the same conditions as indicated in Comparative Example 1. After milling, the dispersion was diluted with 900 g of the aliphatic hydrocarbon. The toner concentrate thus obtained was diluted with the aliphatic hydrocarbon in a ratio of 1:10. In a copier having a photosensitive layer of selenium, i.e., with positive development, satisfactory copies were obtained. If, however, this liquid developer was used for reversal development on ZnO paper, scummed copies, which were unusable for practical purposes, were obtained. Even with a dilution ratio of 1:20, no better result was achieved.

EXAMPLE 1

A toner concentrate prepared in accordance with Comparative Example 2 was diluted, in a ratio of 1:20, with a solution containing 0.075 percent-by-weight of alkylated poly-N-vinyl-2-pyrrolidone (Antaron V220), having a mean chain length of 20 carbon atoms and 20 percent by weight of vinyl-2-pyrrolidone, in an aliphatic hydrocarbon (boiling range: 160°–180° C). When the liquid developer prepared in this manner was employed in a reversal development process on ZnO paper, performed using a conventional microfilm reenlargement apparatus, copies of good quality with regard to scumming, blackening, and image contrast were obtained. The liquid developer has a storage life ranging over several weeks.

EXAMPLE 2

A liquid developer prepared in accordance with Example 1 was used for reversal development in a conventional microfilm re-enlargement apparatus on a polyvinylcarbazole photoconductor. Images of good quality were obtained.

EXAMPLE 3

A toner concentrate prepared in accordance with Comparative Example 2 was diluted, in a ratio of 1:30, with a 0.3 percent-by-weight solution of alkylated poly-N-vinyl-2-pyrrolidone (mean alkyl chain length of 16 carbon atoms) in an aliphatic hydrocarbon (boiling range 175°–190° C). When used for reversal development on ZnO paper, the liquid developer thus produced gave copies of good quality.

What is claimed is:

1. An electrophotographic liquid developer for the reversal development of negatively charged charge images, comprising an electrically insulating carrier liquid of high electrical resistivity and a low dielectric constant, a pigment or dye, a resinous binder, a charge controller comprising a copolymer of N-vinyl-2-pyrrolidone and a methacrylic acid ester, and a poly-N-vinyl-2-pyrrolidone which has been alkylated with an α-olefin, wherein said alkylated poly-N-vinyl-2-pyrrolidone is present in an amount between 0.005 and 1 percent by weight.

2. A liquid developer as in claim 1, wherein said alkylated poly-N-vinyl-2-pyrrolidone is present in an amount between 0.02 and 0.5 percent by weight.

3. A liquid developer as claimed in claim 1, wherein said alkylated poly-N-vinyl-2-pyrrolidone contains about 20 percent by weight of N-vinyl-2-pyrrolidone.

4. A liquid developer as claimed in claim 1, wherein said alkylated poly-N-vinyl-2-pyrrolidone has at least one alkyl radical with 12 to 20 carbon atoms.

5. A process for preparing an electrophotographic liquid developer for the reversal development of negatively charged charge images, comprising the steps of:

(a) producing a homogeneous paste comprising an electrically insulating carrier liquid of a high electrical resistivity and a low dielectric constant, a pigment or dye, a resinous binder, and a charge controller comprising a coplymer of N-vinyl-2-pyrrolidone and methacrylic acid ester;

(b) diluting the homogeneous paste using a carrier liquid optionally containing a charge controller, producing a toner concentrate; and (c) mixing said toner concentrate with a carrier liquid in which a poly-N-vinyl-2-pyrrolidone alkylated with an α-olefin is dissolved, producing an electrophotographic liquid developer that is ready for use and that contains between 0.005 and 1 percent by weight of an alkylated poly-N-vinyl-2-pyrrolidone.

* * * * *